United States Patent [19]

Nanami

[11] Patent Number: 4,896,802

[45] Date of Patent: Jan. 30, 1990

[54] MACHINE FOR PRODUCING BUNDLED PLASTIC TAPE PRODUCTS SUCH AS POMPONS

[75] Inventor: Hiroo Nanami, Shizuoka, Japan

[73] Assignee: Kabushikigaisha Nanami, Shizuoka, Japan

[21] Appl. No.: 212,635

[22] Filed: Jun. 28, 1988

[30] Foreign Application Priority Data

Jun. 30, 1987 [JP] Japan ..... 62-163817

[51] Int. Cl.[4] ..... D04D 7/06; A41H 43/00

[52] U.S. Cl. ..... 223/46; 428/4

[58] Field of Search ..... 28/147; 223/46; 242/56 B, 56.2, 56.6

[56] References Cited

U.S. PATENT DOCUMENTS 298,670 5/1884 Crosby ..... 242/56.6
331,803 12/1885 Lumsden ..... 242/56.6
1,063,288 6/1913 Rosenberg ..... 28/147
1,402,848 1/1922 Dutro et al. ..... 242/56.6
3,682,031 8/1972 Degelleke et al. ..... 242/56.2
4,201,352 5/1980 Madachy ..... 242/56.2

*Primary Examiner*—Werner H. Schroeder
*Assistant Examiner*—David K. Suto
*Attorney, Agent, or Firm*—Sughrue, Mion, Zinn, Macpeak & Seas

[57] ABSTRACT

A machine for producing pompons in which an indefinite length of thin plastic tape 9 is ripped into a plurality of strips of constant width, the strips are cut off to a predetermined length, and the cut strips are bundled at their central areas. The machine includes a shaft 7 for rotatably supporting a tape roll 11 wound about a core 10, a ripping device 4 for ripping the tape into strips, and a reel 5 about which the strips are wound mounted on a common framework 1. The ripping device has a plurality of equally spaced cutters 34. The outer periphery of the reel is provided with at least two recesses 48 through one of which a string 54 is passed to bundle the strips and through the other of which a knife or scissors for removing the strips from the reel is passed.

9 Claims, 9 Drawing Sheets

FIG. 13 (1)
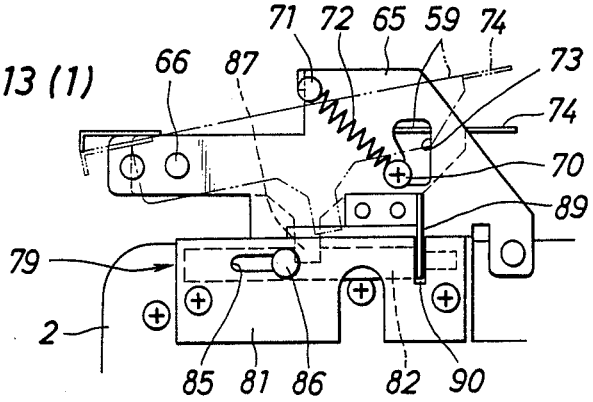
FIG. 13(2)
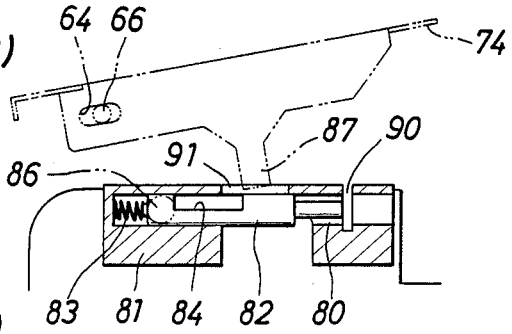
FIG. 13(3)
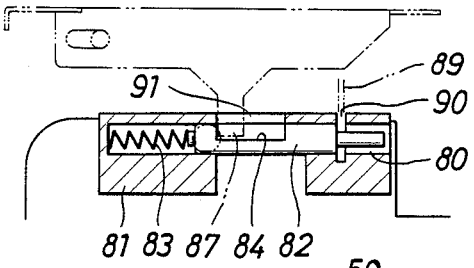
FIG. 13(4)
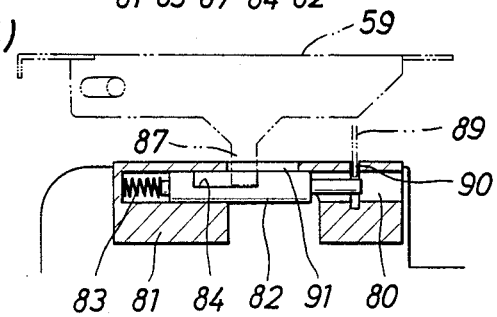

MACHINE FOR PRODUCING BUNDLED PLASTIC TAPE PRODUCTS SUCH AS POMPONS

BACKGROUND OF THE INVENTION

This invention relates to a machine for producing bundled plastic tape products such as pompons to be used for cheering various sport matches including mass games, volley balls and the like and more particularly, a machine adapted to rip an indefinite length of thin plastic tape in the longitudinal direction into strips of equal width, cut the strips to a desired length and bundle the cut strips at their central areas in the length thereof.

Hithertofore, pompons have been generally handmade by the users themselves. That is, the user bought a commercially available packing tape roll comprising a thin polyethylene tape having the width of about 5 cm wound about a core, payed the cut tape out of the tape roll, cut the payed out length of the tape to tape pieces each having a predetermined length (about 60–100 cm) by means of scissors or the like cutting means, folded the tape pieces double at their central areas in the length thereof to a substantially U-shape, bundled the folded tape portions by a string and manually ripped the bundled tape pieces one by one from the opposite ends thereof. Alternatively, the user folded the tape into a plurality of loops while manually paying the tape out of the tape roll, put the loops together, bundled the assembled loops at the central areas thereof by a string, cut the loops at their opposite ends by means of scissors or the like and then manually ripped the loops from their cut opposite ends towards the bundled central areas thereof.

One of the prior art pompons is disclosed in Japanese Laid-Open Utility Model Appln. Publication No. 24291/1986. The pompon is produced by preparing a plurality of relatively broad polyethylene sheets, cutting a plurality of slits in each of the sheets extending from one side edge to a position short of the other side edge of the sheet by means of scissors leaving a non-slitted portion adjacent to the other side edge so as to make a fringed sheet, placing the fringed sheets one upon another, rolling the fringed sheets at their non-slitted portions, holding the rolled sheets in the rolled condition by a circular cap-shaped holder and fastening the sheets and holder together by means of a screw or screws. Japanese Laid-Open Patent Appln. Publication No. 20017/1984 discloses a method for producing cheering pompons. The method of this Japanese application also produces cheering pompons by preparing a plurality of relatively broad polyethylene sheets of substantially the same length, cutting a plurality of slits in each of the sheets from the opposite ends towards the central area in the length thereof by means of scissors or the like except for the central area thereof leaving a non-slitted portion at the central area and bundling the slitted sheets together at the central areas by means of a string.

However, the prior art pompons have been produced by the methods which are quite time-consuming and tedious. Thus, simple and less expensive machines for producing pompons which can be simply operated requiring no complicated mechanical or electric power have been demanded by sport bodies, performance companies, schools and kindergartens where pompons are frequently used.

SUMMARY OF THE INVENTION

Thus, the present invention has its object to provide a machine for producing pompons which meets such demand. According to the present invention, the demand can be met by the following construction and arrangement of the components of the machine.

That is, the machine comprises a roll supporting shaft for rotatably supporting a tape roll comprising an indefinite length of plastic tape wound about a take-up core, a ripping device for ripping the tape into strips, a reel for taking up the strips and a framework on which the shaft, ripping device and take-up reel are mounted. The ripping device has a plurality of cutters equally spaced in the axial direction of the device for ripping the plastic tape into a plurality of strips of uniform width as the plastic tape is payed out of the tape roll by the result of the tape being wound about a take-up reel. The outer periphery of the reel is formed with two angularly spaced recesses, a first recess through which a string is passed for bundling the wound strips together, and a second recess through which a knife or scissors for cutting the bundled strips and removing them from the take-up reel are passed.

The two recesses are provided in the outer periphery of the reel in opposing and spaced relationship in symmetry with respect to the shaft of the reel and thus, when the strips are cut and removed from the reel, the bundled portion of the strip bundle is positioned at the central area of the bundle. The reel is preferably provided with flanges on the opposite sides thereof and the shaft of the reel has a handle secured thereto.

The shaft for supporting the tape roll is journalled at the opposite ends in bearing recesses provided in the framework and removable from the framework so that the tape roll can be easily replaced by a new tape roll.

In order to tension the tape being payed out of the tape roll, a tension lever is preferably provided on the framework for abutting against the outer periphery of the tape roll.

The plurality of cutters on the ripping device may be in the shape of a rectangle or circle, but in either case, the arrangement is so made that a common ripping anvil is disposed in opposition to the cutters, the plastic tape is passed through the space between the cutters and anvil and the tape is automatically ripped by the cutters as the tape is payed out of the tape roll as the reel rotates. Whether the cutters are rectangular or circular, when the cutters are held on a cutter holder mounted on the framework for opening and closing so that the cutters can be retracted from the ripping anvil, the tape can be conveniently handled.

The above and other objects and attendant advantages of the present invention will be more readily apparent to those skilled in the art from a reading of the following detailed description in conjunction with the accompanying drawings which show preferred embodiments of the present invention for illustration purpose only, but not limiting the scope of the same in any way.

BRIEF DESCRIPTION OF THE DRAWINGS

FIG. 13 (1), (2), (3) and (4) are explanative views showing the operation sequence of the lock mechanism of the safety cover in the pompon producing machine shown in FIG. 10.

PREFERRED EMBODIMENTS OF THE INVENTION

Figure 1:
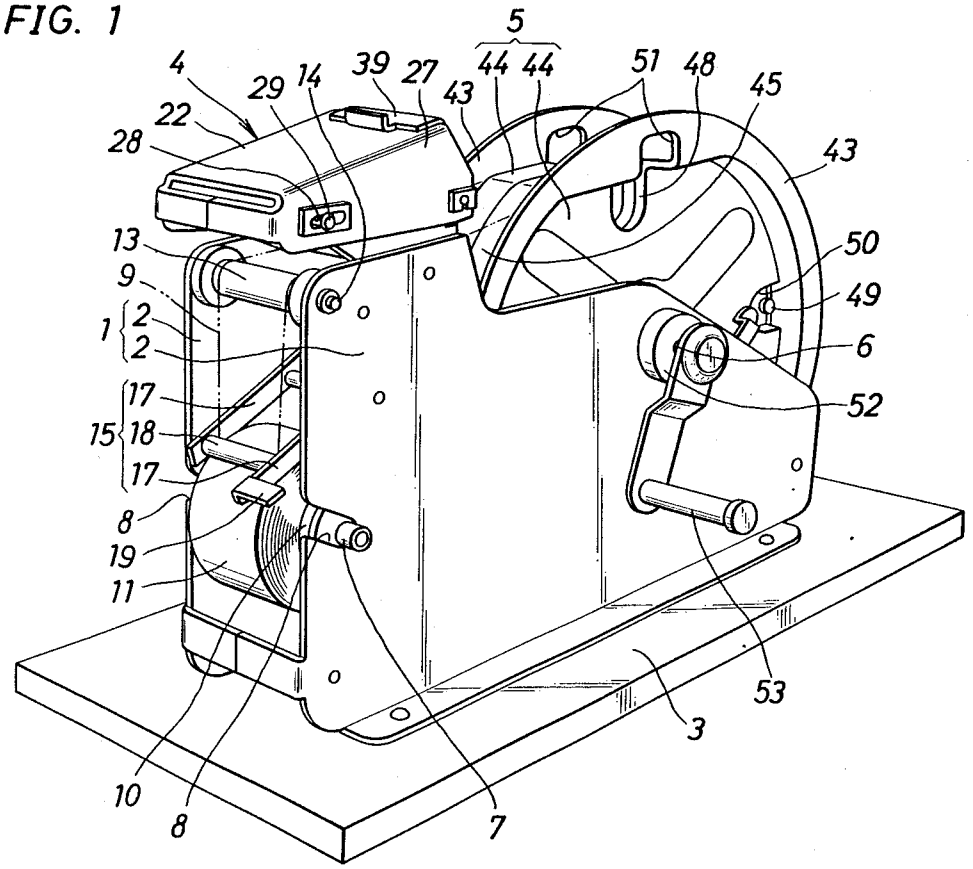
FIG. 1 is a perspective front elevational view of a first embodiment of the pompon producing machine constructed in accordance with the present invention.

The present invention will be now described referring to the accompanying drawings and more particularly, to FIGS. 1 to 8 inclusive in which the first embodiment of the pompon producing machine of the present invention is shown. As shown in FIG. 1, the machine comprises a framework 1 consisting of a pair of parallel and spaced vertical side plates 2, 2 and is secured to a base 3 by means of screws. A ripping device 4 is mounted on the top of the framework 1 in a front portion thereof straddling the side plates and a reel 5 is rotatably mounted on the top of the framework 1 in a position rearwardly of the ripping device 4 by means of a transverse shaft 6. A slightly downwardly sloped U-shaped bearing recess 8 is formed at the leading side edge of each side plate 2 in an intermediate position between the upper and lower ends thereof and the recesses 8 in the side plates 2 are in alignment with each other for supporting a transverse roll supporting shaft 7 horizontally. The roll supporting shaft 7 is designed to removably hold a tape roll 11 comprising an indefinite length of plastic tape 9 wound about a hollow core 10 and as more clearly shown in FIG. 2, a pair of rotary vanes 12, 12 are rotatably mounted at a central area in the longitudinal direction of the roll supporting shaft 7 and fitted within the core 10.

Thus, after the rotary vanes 12 have been fitted within the core 10, the tape roll 11 is rotatably and removably held at the leading side edges of the side plates 2 when the roll supporting shaft 7 is inserted into the bearing recesses 8 in the side plates 2.

A guide roller 13 is rotatably supported at the leading side edges of the side plates 2 at the upper ends thereof by means of a transverse shaft 14 and a tension lever 15 is journalled in the side plates 2 for rotation in a vertical plane by means of a pivot 16 (FIG. 2) below the guide roller 13. The tension lever 15 comprises two parallel and spaced plates 17, 17 rotatably supported at the rear ends on the pivot 16 and a transverse holding-down bar 18 extending and connecting between the leading ends of the plates 17. One of the plates 17 (the right-hand plate in FIG. 1) is integrally formed at the leading end with a laterally and outwardly extending finger piece 19. The tension lever 15 is downwardly biased by a spring 21 extending between and anchored to the rear end of the lever and a stud 20 secured at the opposite ends to the side plates 2 so that the holding-down bar 18 may abut against the outer periphery of the tape roll 11. The abutment of the holding-down bar 18 against the tape roll 11 prevents the roll from unrolling inadvertently and also applies a constant tension thereto as the tape is payed out of the roll. When the tape roll is to be replaced by a new tape roll, the operator places his finger or fingers on the finger piece 19 so as to raise the tension lever 15. In operation, the tape 9 is payed out of the tape roll 11 and guided over the guide roller 13 to the ripping device 4 where the tape is ripped and then transported to the reel 5 to be wound about the reel 5 as will be described hereinafter.

The ripping device 4 has a safety cover 22 fitted over the upper end portions of the side plates 2 and the following mechanism is mounted between the inner side of the safety cover 22 and the side plates 2.

Figure 2:
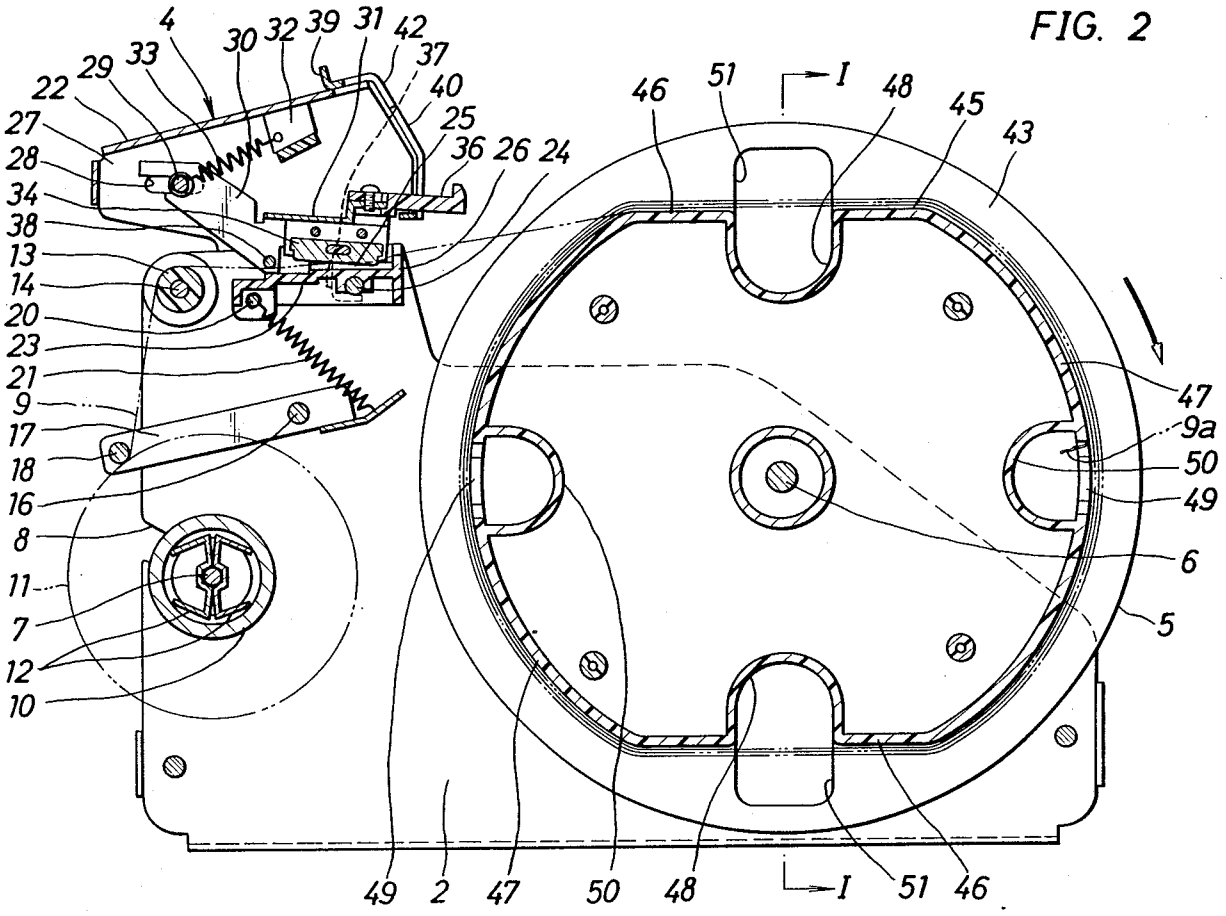
FIG. 2 is a vertically sectional view of the machine of FIG. 1 on an enlarged scale showing an indefinite length of plastic tape is being wound about the take-up reel while being ripped by the cutters of the ripping device set in the operative position with the base shown in FIG. 1 cut away.
Figure 3:
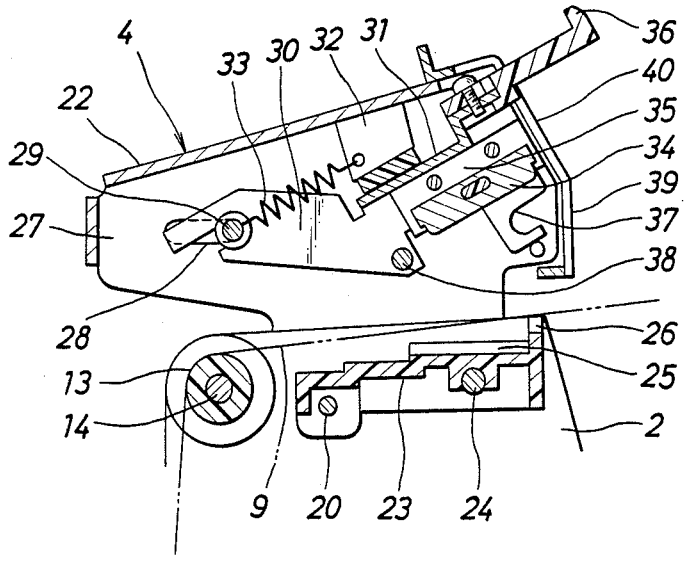
FIG. 3 is a vertically sectional view of the ripping device showing the cutters of the device in the retracted position.

As more clearly shown in FIGS. 2 and 3, an integrally formed synthetic resin ripping anvil 23 is fixedly supported in a horizontal plane between the upper end portions of the side plates by the above-mentioned stud 20 and a second stud 24 disposed rearwardly of the stud 20. As understood from FIGS. 3 and 4, the rear-half portion of the upper surface of the ripping anvil 23 is formed with a plurality of parallel narrow grooves 25, 25 . . . extending in the back and forth direction of the anvil and equally spaced laterally by a constant distance (see FIGS. 3 and 4). The level of the bottom surfaces of these narrow grooves 25 is substantially the same as that of the outer periphery of the guide roller 13. The rear edge of the upper surface of the ripping anvil 23 is formed with convexes 26 at the rear ends of the grooves 25.

Figure 4:
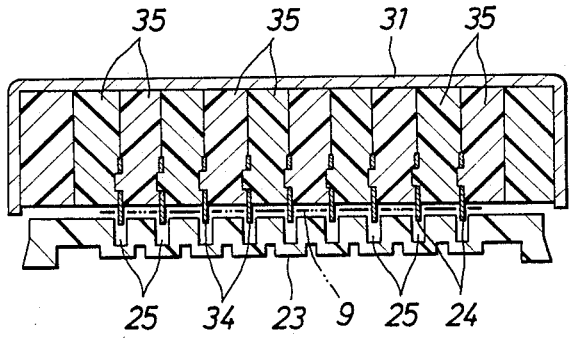
FIG. 4 is a cross-sectional view on a further enlarged scale of the cutters of the ripping device and the ripping anvil.
Figure 5:
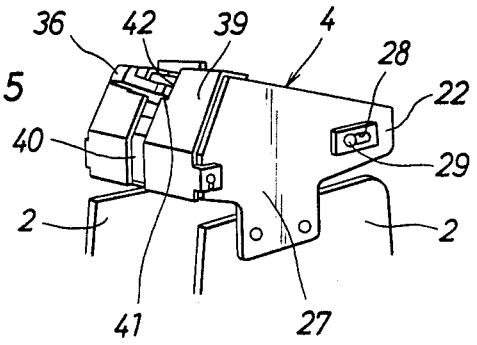
FIG. 5 is a perspective view of the ripping device as seen from the side opposite to that of FIG. 1.
Figure 6:
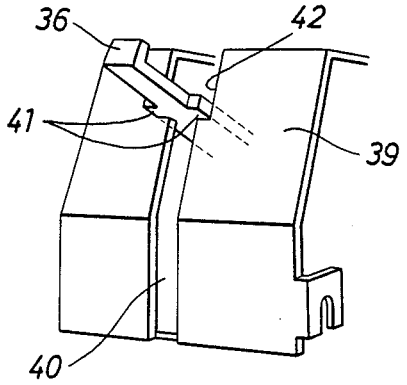
FIG. 6 is a perspective view of a portion of FIG. 5 on an enlarged scale.
Figure 7:
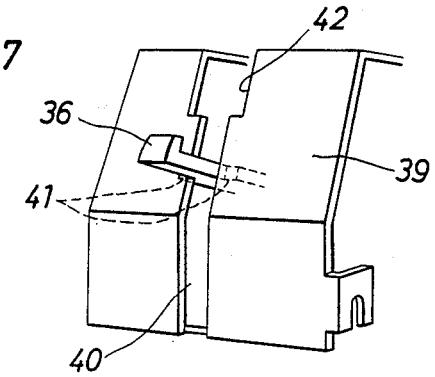
FIG. 7 is similar to FIG. 6, but shows the operation lever for the cutter holder in a position lower than the position thereof shown in FIG. 6.

The safety cover 22 has right- and left-hand side walls 27, 27 provided with aligned guide slots 28, 28 in which a slide shaft 29 is received for slidable movement in the back and forth direction of the cover. A cutter holder 31 is pivoted to the slide shaft 29 for rotation in a vertical plane and has right- and left-hand arms 30, 30 on the opposite sides. The slide shaft 29 and the cutter holder 31 are rearwardly biased by a spring 33 extending between and anchored to the slide shaft and an ear 32 on the inner surface of the safety cover 22. As seen from FIG. 4, a plurality of cutters 34 in the form of rectangular plates are fixedly secured to the cutter holder 31 in parallel and equally spaced relationship (about 5 mm, for example) with spacer blocks 35 interposed therebetween. Each of the cutters 34 is positioned opposite to each of the narrow grooves 25 in the anvil 23 and can enter the respectively opposing groove 25. The cutter holder 31 further has an operation lever 36 secured to the upper surface thereof and right- and left-hand hooks 37, 37 secured to the undersurface of the holder at the rear end thereof. Further secured to the cutter holder 31 between the right- and left-hand side arms 30 is a tape holding-down bar 38 to hold down the tape 9 being payed out of the tape roll 11. The leading end of the operation lever 36 projects outwardly through a guide-slot 40 in a rear cover 39 having an upper widened portion 42 closing the open rear end of the safety cover 22 as shown in FIG. 5. The operation lever 36 has ears 41 on the opposite sides thereof as shown in FIG. 6. The ears 41 project outwardly through the widened upper portion 42 of the slot 4.

Thus, as the operation lever 36 is lowered along the guide slot 40 from the widened upper portion 42 to the narrower lower portion of the guide slot 40 to retract the ears 41 into the rear cover 39 to thereby push the cutter holder 31 forwardly against the force of the spring 33, the cutter holder 31 is pivoted downwardly about the slide shaft 29 until the hooks 37 abut against the stud 24 as shown in FIG. 2. The cutter holder 31 is thus maintained in the position shown in FIG. 2. In this position of the cutter holder 31 as shown in FIG. 2, the tape holding-down bar 38 pushes down the tape 9 extending between the guide roller 13 and the reel 5 against the convexes 26 at the rear end edge of the anvil 23 and also forces the cutters 34 and accordingly, the tape 9 into the narrow grooves 25 in the anvil 23.

However, when the operation lever 36 is manipulated to push the cutter holder 31 forwardly to disengage the hooks 37 from the stud 24 and then the operation lever 36 is moved upwardly from the narrow portion into the wider upper portion 42 of the guide holder 40 while rotating the cutter holder 31 until the ears 41 on the operation lever 36 project outwardly through the slot widened upper portion 42 and thereafter, when the operation lever 36 is released, the cutter holder 31 is moved upwardly from the ripping anvil 23 to release the tape 9 as shown in FIG. 3 and is held in this position.

Figure 8:
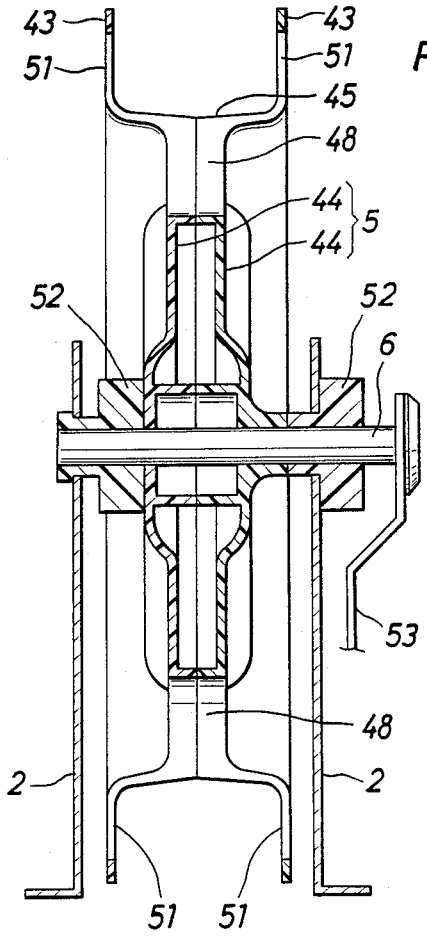
FIG. 8 is a vertically sectional view taken along substantially the line I—I of FIG. 2.

As more clearly shown in FIGS. 1 and 8, the reel 5 comprises an assembly of two complementary circular plastic members 44, 44 each integrally formed with a flange 43 and a take-up drum portion 45 interposed between the flanges 43. The complementary circular members 44 are secured to the reel shaft 6 for rotation therewith. The drum portion 45 comprises two opposing and parallel flat portions 46, 46 encircling the reel shaft 6 in an equally spaced relationship to the shaft and two opposing arcuate portions 47, 47 positioned between and integrally connected to the flat portions 46 as shown in FIG. 2. As will be described hereinafter, the flat portions 46 are formed at their central areas with U-shaped recesses 48 through which a string adapted to bundle strips obtained by ripping the tape 9 and wound about the take-up drum 45 and a knife or scissors adapted to cut the bundle of tape strips to remove the bundled strips from the reel pass, respectively. The ripping of the tape into strips and the bundling of the strips will be described hereinafter. Similarly, the arcuate portions 47 are formed at their central areas with slits 49 through which the leading end **9*a* of the tape 9 is passed to be anchored to the drum portion 45 of the reel 5 and U-shaped recesses 50 to anchor the tape leading end 9*a*. The flanges 43 on the opposite sides of the drum portion 45 are formed with openings 51 in communication with the recesses 48 in the flat portions 46** to increase the opening area.

The reel shaft 6 is journalled in bearings 52 secured to the right- and left-hand side plates 2 and has a manual handle 53 secured to one end of the shaft for manually rotating the reel shaft 6.

Next, the operation of the pompon producing machine will be now described. First, the tape roll 11 is supported on the roll supporting shaft 7 between the side plates 2 and the cutter holder 31 is moved up to the retracted position as shown in FIG. 3. The plastic tape 9 is payed out of the tape roll 11 with the tension lever 15 held in its raised position and passed over the guide roller 13 into the space between the cutter holder 31 and the ripping anvil 23. The leading end **9*a* of the tape 9 is then passed through a selected one of the slits 49 in the drum portion 45 and anchored to the drum portion 45 by knotting the tape leading end. Thereafter, the cutter holder 31 is lowered to the position shown in FIG. 2 and held in this position to thereby lower the cutters into the corresponding narrow grooves 25 in the ripping anvil 23 so as to push the tape 9 into the grooves 25 as shown in FIG. 4**.

When the reel 5 is rotated by the handle 53 with the tape 9 held in the grooves 25, the tape 9 is payed out of the tape roll 11 and passed over the guide roller 13 into the space between the cutter holder 31 and the ripping anvil 23.

Figure 9:
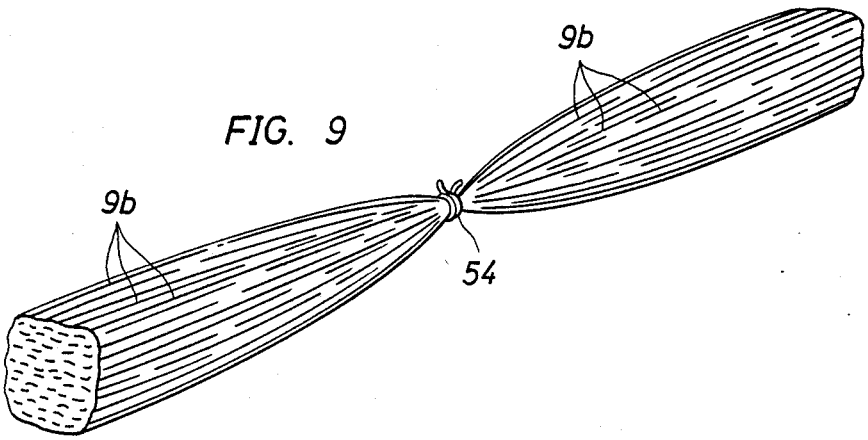
FIG. 9 is a perspective view of a bundle of tape strips produced by the pompon producing machine according to the present invention.

While the tape 9 is passing through the space between the cutter holder 31 and the ripping anvil 23, the tape 9 is ripped into a plurality of parallel narrow strips having an equal width (about 5 mm) and the strips are then wound about the take-up drum portion 45 of the reel 5. Since the length of the tape strips wound about the drum portion 45 can be presumed by the number of rotations of the reel 5 or the total thickness of the layers of the tape strips wound about the reel drum portion 45, when the tape strips have been deposited on the drum portion 45 by a predetermined amount, the tape strips are cut off between the ripping device 4 and the reel 5. The tape strips wound about the take-up reel 5 are bundled by passing a string through the then upper recess of the pair of the recesses 48 in the reel 5. Thereafter, the reel 5 is rotated by one half of one complete rotation of the reel to position the then lower recess 48 to the upper position occupied by the first-mentioned recess and the bundled strips are removed from the reel 5 by cutting off the strips by a knife or scissors whereupon a tape bundle of narrow tape strips **9*b* bundled by the string 54 at a central area in the length of the tape bundle can be obtained, as shown in FIG. 9. The tape strip bundle becomes a desired pompon by fraying the layers of the strips on the opposite sides thereof or providing suitable finger engaging means at the central area of the strip bundle. And any known counter may be conveniently provided on one of the side plates 2 in a suitable position thereon for counting the number of rotations of the reel 5**.

FIGS. 10 to 13 inclusive show the second embodiment of the present invention. The substantial difference between the first and second embodiments resides in the construction of the ripping device for ripping an indefinite length of plastic tape. Although the other components of the second embodiment are slightly different from the corresponding components of the first embodiment, they are substantially similar to the corresponding components of the first embodiment and thus, the same numerals as those affixed to the corresponding components of the first embodiment are also affixed to the similar components of the second embodiment.

Figure 10:
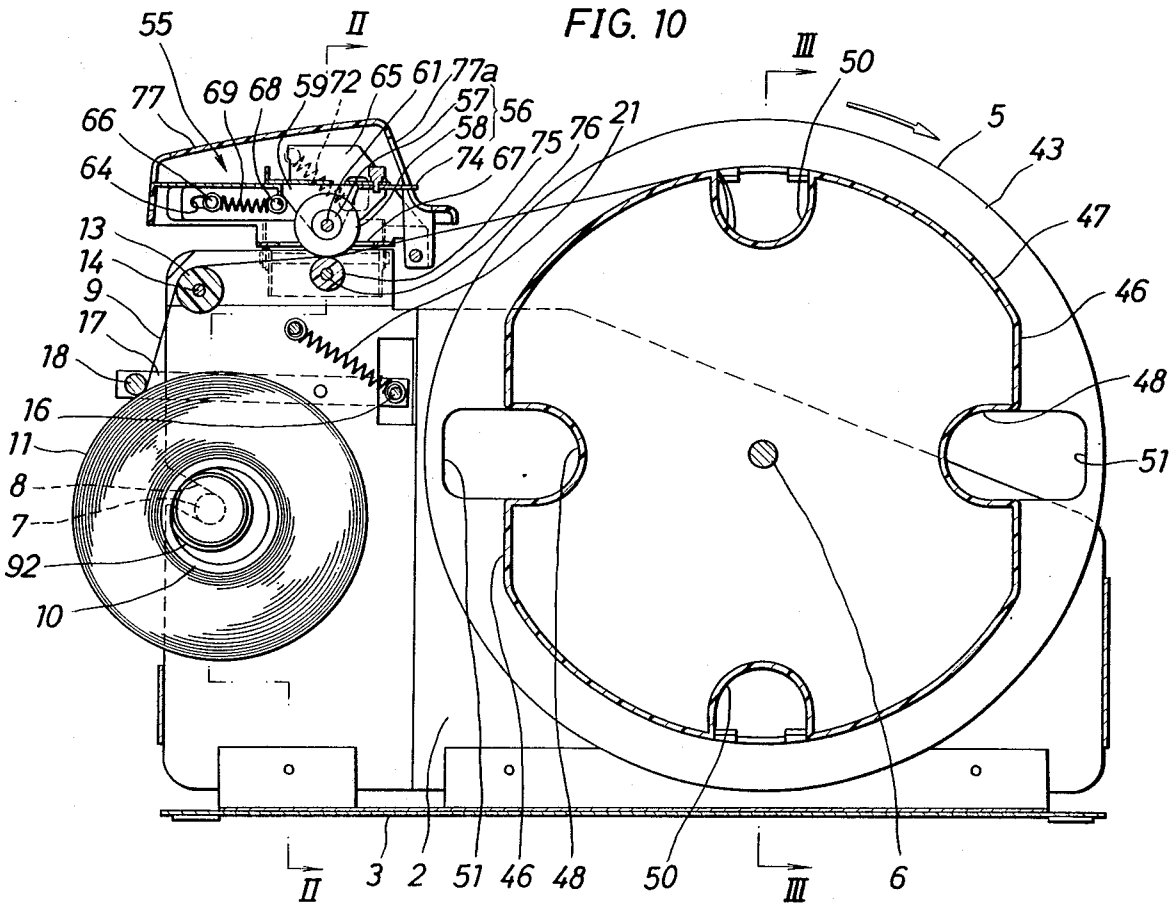
FIG. 10 is a vertically sectional view of a second embodiment of the pompon producing machine constructed in accordance with the present invention.

In the ripping device 55 for the second embodiment, a rotary cutter assembly 56 is employed. As more clearly shown in FIG. 11, the cutter assembly 56 comprises a column-shaped core 57 and a plurality of parallel circular cutters 58 secured to the core in an equally spaced relationship in the axial direction of the core and journalled on a transverse shaft 61 between the right- and left-hand bearing plates 60, 60 of the cutter holder 59. The upper half portions of the circular cutters 58 are covered by a cutter cover 62 secured between the bearing plates 60. The cutter cover 62 has a plurality of slits 63 through which the respective circular cutters 58 pass. The cutter holder 59 has slots 64 shown in FIG. 10 and when pins 66 secured to an attachment frame member 65 engage in the slots 64, the cutter holder 59 is mounted on the attachment frame member 65 for vertical rotation and movement in the back and forth direction by a limited distance. The attachment frame member 65 has a plurality of slits 67 through which the respective circular cutters 58 project downwardly of the frame member. The cutter holder 59 is biased forwardly (the left-hand direction as seen in FIG. 10) by a tension spring 69 anchored to the above-mentioned pin 66 and a pin 68 on the cutter holder 59 and also biased upwardly by another tension spring 72 extending between and anchored to a pin 70 on the cutter holder 59 and a pin 71 on the attachment frame member 65 as shown in FIG. 13 (1). The attachment frame member 65 has a rather large L-shaped hole 73 for receiving the pin 70 on the cutter holder 59 and the cutter holder 59 has a knob 74 at the rear end.

As more clearly shown in FIG. 13 (1), when the pin 70 engages the lower end of the hole 73, the cutter holder 59 is held in the lower position as shown by the solid line whereby the cutters 58 project to a position below the slits 67 in the attachment frame member 65. When the cutter holder 59 is raised while being pulled rightwards as seen in FIG. 13 (1) until the pin 70 on the holder engages the upper end of the hole 73, the cutter holder 59 is held in the upper position as shown by the chain line whereby the cutters 58 come out of the slits 67 and are positioned above the slits 67.

A column-shaped ripping anvil 75 formed of metal or plastic is mounted on a shaft 76 in opposition to the cutter assembly 56 between the upper end portions of the right- and left-hand side plates 2. When the cutter holder 59 is held in the position below the attachment frame member 65 as mentioned hereinabove, the cutters 58 force the tape 9 being payed out of the tape roll 11 against the periphery of the ripping anvil 75 and cut into the tape 9. Thus, when the tape 9 is payed out of the tape roll 11 as the reel 5 is rotated, the tape 9 is ripped into a plurality of narrow strips and the strips are wound about the reel as described in connection with the first embodiment.

The attachment frame member 65 has a safety cover 77 secured thereto to cover the frame member itself and the cutter holder 59.

Figure 11:
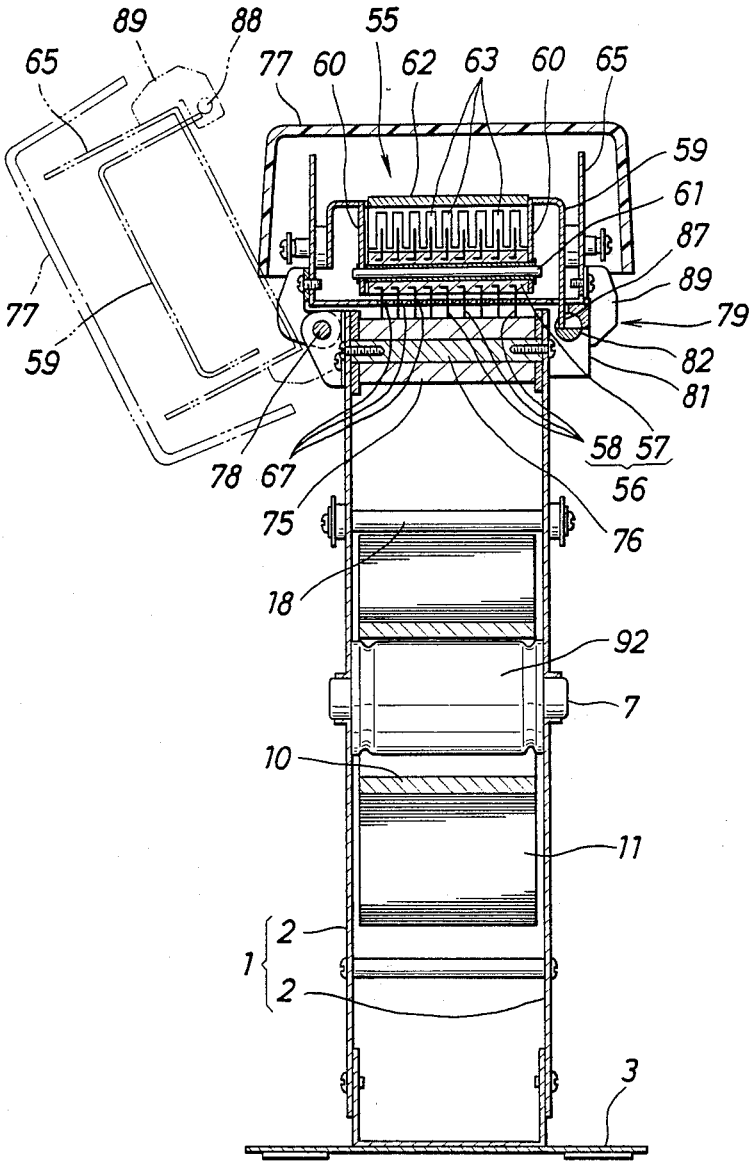
FIG. 11 is a vertically sectional view taken along substantially the line II—II of FIG. 10.
Figure 12:
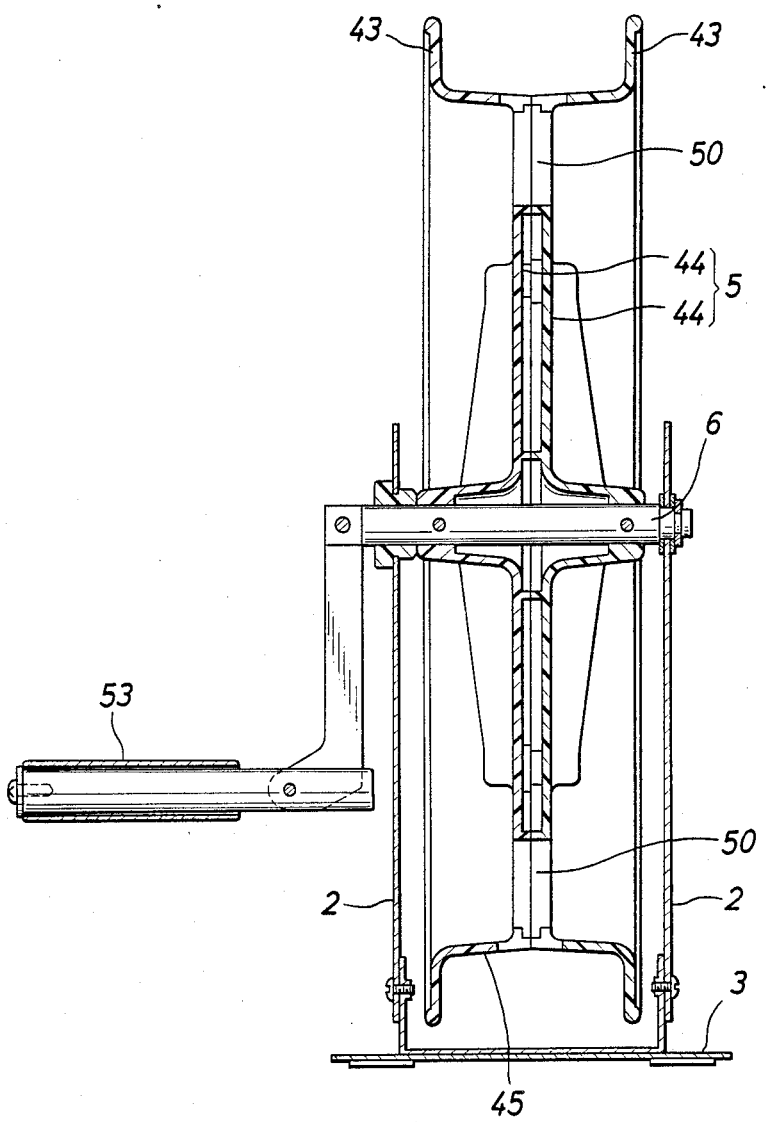
FIG. 12 is a vertically sectional view taken along substantially the line III—III of FIG. 10.

The safety cover 77 has an access opening **77*a* through which the cutter holder 59 can be operated from outside. The attachment frame member 65 is pivotally mounted on the outer side of the upper end portion of the left-hand side plate 2 as seen in FIG. 11 by means of a pivot 78 and the attachment frame member 65 and the safety cover 78 can be opened and closed in unison. When the attachment frame member 65 and the safety cover 78 are opened as shown by the chain line in FIG. 11, the cutter assembly 56 displaces outwardly of the side plate 2 together with the attachment frame member 65 to clear above the ripping anvil 76**.

A lock mechanism 79 is provided on the outer side of the upper end portion of the right-hand side plate 2 for locking the attachment frame member 65 in its locked position. In FIG. 13, a sheath member 81 having a guide slot 80 is shown as being secured to the outer surface of the right-hand side plate 2 and a lock pin 82 is slidably received in the slot. The lock pin 82 is biased rightwards (as seen in FIG. 13) by a spring 83 disposed at the left-hand end of the guide slot 80 as seen in FIG. 13. The lock pin 82 is formed in an intermediate position of the upper surface thereof with a recess 84 and has a knob 86 protruding outwardly through a slit 85 in the sheath member 81. On the other hand, the cutter holder 59 has a projection 87 depending from one side at a central area thereof and the attachment frame member 65 has a lock piece 89 having a slot 88 secured to the outer surface thereof as shown in FIG. 13.

The lock piece 89 fits in a slit 90 in the upper surface of the sheath member 81 when the attachment frame member 65 is closed as shown in FIG. 13 (1) and (3) and the opening 88 aligns with the guide slot 80. Therefore, the leading end of the lock pin 82 extends through the opening 88 and the attachment frame member 65 is locked in its closed position together with the safety cover 77. At this time, if the cutter holder 59 is held in a position lower than the attachment frame member 65 as shown in FIG. 13 (1), the lower end of the projection 87 extends through another slit 91 in the upper surface of the sheath member 81 into another recess 84 in the lock pin 82 whereby even if the operator grips the knob 86 to slide the lock pin 82 leftwards as seen in FIG. 13 (4) against the force of the spring 83, since the projection 87 engages one end of the recess 84 to control the slidable movement of the lock pin 82, the leading end of the lock pin 82 is prevented from coming out of the opening 88 in the lock piece 89 and accordingly, the attachment frame member 65 can not be opened. However, when the cutter holder 59 is raised to the position above the attachment frame member 65 as shown by the chain line in FIG. 13 and held in the position as shown in FIG. 13 (2), since the projection 87 on the cutter holder 59 disengages from the recess 84 as shown in FIG. 13 (2), the lock pin 82 is allowed to slide leftwards against the force of the spring 83 to come out of the opening 88 in the lock piece 89 whereby the attachment frame member 65 as well as the safety cover 77 can be released as shown by the chain line in FIG. 11.

In the embodiment shown in FIGS. 10 to 13 inclusive, the roll supporting shaft 7 has a cylindrical portion 92 which supports the core 10 of the tape roll 11 for free movement.

The application of the present invention is not limited to the illustrated embodiments and many changes and modifications may be made without departing from the spirit and scope of the principle of the present invention. And the pompon producing machine of the present invention can be also applied to the production of other bundled plastic tape products other than pompons.

What is claimed is:

1. A machine for producing bundled plastic tape products such as pompons, comprising: a roll supporting shaft (7) for rotatably supporting a tape roll (11) comprising a plastic tape (9) wound about a core, a ripping device (4) for ripping said tape into strips, and a reel (5) for winding said strips thereabout mounted on a common framework (1), said ripping device having a plurality of cutters (34) disposed thereon in an equally spaced relationship in the transverse direction of said tape whereby as said plastic tape is payed out of said tape roll, the tape is ripped in the longitudinal direction of the tape into strips of a constant width, and said reel being provided on an outer periphery thereof with a first recess (48) adapted to pass a string for bundling said strips wound about said reel, and a second recess adapted to pass a knife or scissors for cutting said bundled strips for removing the bundled strips from said reel, wherein said ripping device includes:

(a) a ripping anvil (23) fixedly mounted to said framework and common to said plurality of cutters such that said plastic tape is passed through a space between said anvil and said cutters and automatically ripped as the tape is payed out of said tape roll by the rotation of said reel, (b) a cutter holder (31) mounted to a cover portion (22) of said framework for pivotable and sliding movement relative to said anvil, said holder mounting said cutters, and said anvil defining a plurality of grooves (25) cooperable with and for receiving said cutters, (c) hook means (37) mounted to said cutter holder for engagement with retainer means (24) common to said anvil, (d) an operating lever (36) mounted to said cutter holder for moving said holder between a first position whereat said cutters are removed from said grooves, and a second position whereat said cutters are disposed in said grooves and said hook means are engaged with said retainer means, and (e) spring means (33) for biasing said holder in both said first and second positions.

2. The machine as set forth in claim 1 wherein said two recesses are disposed in opposing relationship in symmetry with respect to said reel shaft.

3. The machine as set forth in claim 1 wherein said reel is provided on the opposite sides of the outer periphery thereof with flanges.

4. The machine as set forth in claim 1 wherein the supporting shaft of said reel has a handle attached thereto.

5. The machine as set forth in claim 1 wherein the supporting shaft of said reel is detachably journalled at the opposite ends in bearing recesses provided in said framework.

6. The machine as set forth in claim 1 wherein a tension lever is mounted on said framework for abutting against the outer periphery of said tape roll supported on the supporting shaft of said tape roll.

7. The machine as set forth in claim 1 wherein said cutters are rectangular and said ripping anvil is provided with a plurality of narrow grooves into which said cutters enter.

8. The machine as set forth in claim 1 wherein said cutters are circular and rotate in unison and said ripping anvil is of column shape.

9. The machine as set forth in claim 1 wherein said cutters are supported in an equally spaced relationship on a cutter holder movable towards and away from said ripping anvil.

* * * * *